US008814129B2

(12) United States Patent
Todd et al.

(10) Patent No.: US 8,814,129 B2
(45) Date of Patent: Aug. 26, 2014

(54) TROLLING MOTOR MOUNT

(76) Inventors: William J. Todd, Rockport, TX (US); Douglas D. Watson, San Antonio, TX (US)

( * ) Notice: Subject to any disclaimer, the term of this patent is extended or adjusted under 35 U.S.C. 154(b) by 125 days.

(21) Appl. No.: 12/689,393

(22) Filed: Jan. 19, 2010

(65) Prior Publication Data

US 2010/0116967 A1 May 13, 2010

Related U.S. Application Data

(63) Continuation-in-part of application No. 12/556,561, filed on Sep. 9, 2009.

(60) Provisional application No. 61/109,985, filed on Oct. 31, 2008.

(51) Int. Cl.

| | |
|---|---|
| ***F16M 1/00*** | (2006.01) |
| ***F16M 3/00*** | (2006.01) |
| ***F16M 5/00*** | (2006.01) |
| ***F16M 7/00*** | (2006.01) |
| ***F16M 9/00*** | (2006.01) |
| ***F16M 11/00*** | (2006.01) |
| ***B63H 20/00*** | (2006.01) |
| ***B63H 21/30*** | (2006.01) |
| ***B63H 20/10*** | (2006.01) |

(52) U.S. Cl.

CPC ..... *B63H 21/30* (2013.01); *B63H 20/007* (2013.01); *B63H 20/10* (2013.01)

USPC ..... 248/642; 248/640; 248/641; 248/643; 114/144 R; 440/6; 440/53

(58) Field of Classification Search

USPC ..... 248/642, 640, 643; 440/6, 7, 63–57, 440/58–60; 114/144 R

See application file for complete search history.

(56) References Cited

U.S. PATENT DOCUMENTS

| | | | | | |
|---|---|---|---|---|---|
| 2,902,967 | A | * | 9/1959 | Wanzer | 440/58 |
| 3,565,372 | A | * | 2/1971 | Jones | 248/647 |
| 3,915,417 | A | * | 10/1975 | Norton et al. | 248/584 |
| 3,930,461 | A | * | 1/1976 | Brock et al. | 440/7 |
| 3,948,204 | A | * | 4/1976 | Brock et al. | 440/6 |
| 4,033,530 | A | * | 7/1977 | Harris | 248/642 |
| 4,268,258 | A | * | 5/1981 | Beem | 440/63 |
| 4,410,161 | A | * | 10/1983 | Booty | 248/642 |
| 4,555,233 | A | * | 11/1985 | Klammer et al. | 440/56 |
| 4,654,014 | A | * | 3/1987 | Peirce et al. | 440/59 |
| 4,875,656 | A | * | 10/1989 | Boede | 248/642 |
| 4,966,566 | A | * | 10/1990 | Baird | 440/6 |
| 5,331,914 | A | * | 7/1994 | Salmons | 114/346 |
| 5,358,434 | A | * | 10/1994 | Brown | 440/60 |
| 5,580,287 | A | * | 12/1996 | Wieringa | 440/6 |

(Continued)

*Primary Examiner* — Nkeisha Smith

(74) *Attorney, Agent, or Firm* — Ober, Kaler, Grimes & Shriver; Royal W. Craig; Christopher F. Lonegro

(57) ABSTRACT

A trolling motor mount comprising a base for attaching the mount to a watercraft, an arm assembly pivotally attached to the base, a motor mount assembly pivotally attached to the arm assembly for rotatably securing the trolling motor, and an actuator adapted to move the arm assembly between a fully deployed position and a fully stowed position. The actuator may comprise a linear actuator. The arm assembly may comprise a single elongated arm or a four bar linkage system. The mount may further comprise a user control such a switch, a wireless remote control, or wired remote control.

11 Claims, 7 Drawing Sheets

(56) References Cited

U.S. PATENT DOCUMENTS

| | | | | |
|---|---|---|---|---|
| 5,954,551 | A * | 9/1999 | King | 440/6 |
| 6,213,821 | B1 * | 4/2001 | Bernloehr et al. | 440/6 |
| 6,863,581 | B2 * | 3/2005 | Anderson | 440/53 |
| 7,004,804 | B2 * | 2/2006 | Bernloehr et al. | 440/63 |
| 7,056,166 | B2 * | 6/2006 | Bernloehr | 440/6 |
| 7,163,427 | B1 * | 1/2007 | Lee | 440/6 |
| 7,195,526 | B2 * | 3/2007 | Bernloehr et al. | 440/63 |
| 7,722,417 | B2 * | 5/2010 | Bernloehr et al. | 440/53 |
| 8,267,193 | B1 * | 9/2012 | Hurley | 173/185 |
| 2007/0232157 | A1 * | 10/2007 | Lee | 440/6 |

* cited by examiner

TROLLING MOTOR MOUNT

CROSS-REFERENCE TO RELATED APPLICATIONS

This application is a continuation-in-part of prior U.S. patent application Ser. No. 12/556,561, filed Sep. 9, 2009, which claims the benefit of U.S. Provisional Patent Application No. 61/109,985, filed Oct. 31, 2008, both of which are hereby incorporated by reference.

BACKGROUND OF THE INVENTION

1. Field of the Invention

The present invention relates to trolling motors and, particularly, to a mount that attaches a trolling motor to a watercraft.

2. Description of the Background

A trolling motor slowly propels a watercraft, for example, yachts, fishing boats, motorboats, sailboat boats, and canoes, and allows for precise maneuvering. A trolling motor generally comprises an electric motor, propeller, shaft, and control housing. Trolling motors are often secondary to a larger primary gasoline or diesel motor and intended for use once the primary motor is shut down.

Although pleasure and sport boaters use trolling motors, trolling motors are primarily used by anglers for low speed trolling and for precision boat positioning while fishing in both freshwater and saltwater. Electric trolling motors create little or no noise, smoke, or disruption in the surrounding water. Trolling motors are generally used on watercraft less than thirty feet in length. The vast majority of trolling motors are powered by direct current supplied by an onboard battery source, for example, gel or dry cell 12-volt, 24-volt, or 36-volt deep cell marine batteries.

Trolling motors are generally mounted on either the bow or the transom with a hinged mount that allows the trolling motor to be retracted from a deployed, in-use position in the water to a stowed, out-of-use position out of the water. Anglers typically chose a bow mount if they spend large amounts of time maneuvering for precise position. Numerous bow mounts that are fastened to the deck have been designed and are in use today, and they all have one thing in common: they are all, to some degree, manually deployed, retracted, and secured.

Conventional bow mounts typically comprise a base that is fastened to the deck at the boat's bow, pivoting arm assembly that moves from a deployed position to a stowed position with manual manipulation, and a trolling motor attachment assembly. When an angler wants to either stow or deploy the trolling motor, the angler uses a rope handle that is attached to the pivoting arm assembly or attachment assembly to lift and rotate the arm assembly between a stowed position and a deployed position.

Several disadvantages are presented with such known bow mounts. The trolling motor's weight is entirely cantilever supported by the pivoting arm assembly and the attachment means. This weight distribution requires the application of a large force on the rope handle to rotate the arm assembly. Thus, deploying or stowing the trolling motor typically requires more than one hand to pivot the arm assembly. These mounting apparatuses also force the angler to reach and bend over on the edge of the boat to grab the rope handle, which is inconvenient, difficult, and sometimes dangerous, and some anglers may not have sufficient dexterity or strength to move the trolling motor between the deployed and stowed positions. Further, manual deployment and retraction of the trolling motor using the rope handle diverts an angler's attention from fishing to operating the mount to ensure that the trolling motor is not dropped abruptly. These disadvantages are amplified when fishing on open lakes and bays where breaking waves and gusting winds occur.

The trolling motor mount as described in U.S. Pat. Nos. 7,195,526 and 7,004,804 by Bernloehr et al. uses a motion dampening device, for example, a gas or pneumatic spring, to merely control the velocity of the pivoting arm assembly and to assist in the movement of the pivoting arm from the deployed position and the stowed position. This mount, however, still fails to eliminate the shortcomings associate with convention bow mounts: the mount operator still must pull a rope handle to pivot the arm assembly, which in turn requires a certain degree of strength, exteriority, and attention.

SUMMARY OF THE INVENTION

It is, therefore, an object of the present invention to provide a trolling motor mount that permits the operator to automatically deploy, stow, and secure the trolling motor when in use on the water.

It is another object to permit operators of any age, size, or physical condition to safely utilize a trolling motor mount.

It is another object to provide a trolling motor mount that is easy to install, operate, and maintain.

It is yet another object to initiate deployment and retraction of the trolling motor from any position on the boat without having to stand in close proximity to the motor mount.

It is another object to permit hands free operation of the mount while fishing or enjoying other boating activities.

And it is another object to provide a trolling motor mount that is easily installed as an aftermarket item for existing users.

According to the present invention, the above-described and other objects are accomplished, by a trolling motor mount comprising a base for attaching the mount to a watercraft, an arm assembly pivotally attached to the base, a motor mounting assembly pivotally attached to the arm assembly for rotatably securing the trolling motor, and an actuator adapted to move the arm assembly between a fully deployed position and a fully stowed position. The actuator may comprise any electronic or hydraulic actuator. The arm assembly may comprise either a single elongated arm or a four bar linkage system. The mount may further comprise a user control, such as a switch or wireless or wired remote control, to activate the actuator.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION OF THE PREFERRED EMBODIMENT

Figure 1:
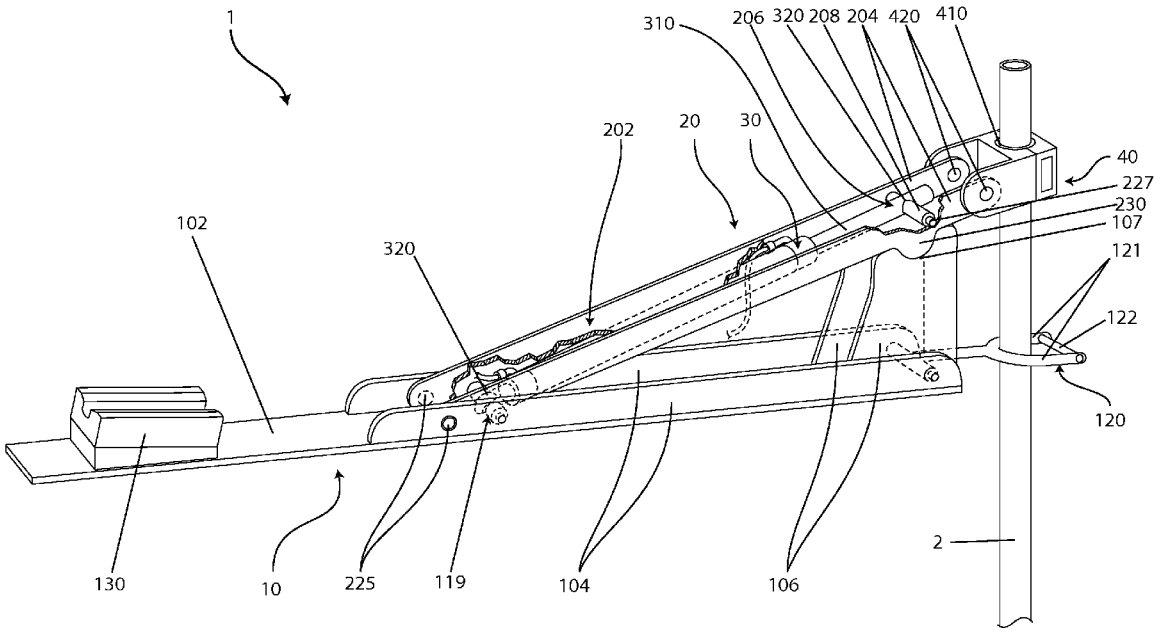
FIG. 1 is a perspective view of an embodiment of the mount in the deployed position.

The trolling motor mount 1 is used to attach a trolling motor to a watercraft. The watercraft may be of any size, configuration, and use. A conventional trolling motor comprises a propulsion unit (a motor and propeller), shaft 2, and control housing. Referring collectively to FIGS. 1-6, the trolling motor mount 1 comprises a base 10, an arm assembly 20, an actuator 30, and a motor mounting assembly 40. The trolling motor mount 1 positions the trolling motor between an in-use, deployed position and an out-of-use, stowed position. In the deployed position, the motor's propulsion unit is submerged in the water and the shaft 2 is generally vertical (as in FIGS. 1 and 4), and in the stowed position, the propulsion unit is out of the water and the shaft 2 is generally horizontal (as in FIGS. 2 and 6).

The base 10 is fixedly attached to the watercraft's deck to secure the mount 1 to the watercraft. For example, the base 10 may comprises a plurality of holes for fastening the mount 1 to the deck of the watercraft using screws or bolts. The base 10 is shaped to sit flush against the deck. In an embodiment, the base 10 is an elongated rectangular member having a flat bottom surface 102 extending to opposing side walls 104. The side walls 104 preferably extend vertically upward from bottom surface 102. The side walls 104 may further comprise a front arm rest 106 that supports the arm 20 in the deployed position. The front arm rest 106 comprises a pair of panels that protrude upward beyond the side walls 104 to engage the inclined arm assembly 20 at a predetermined distance from the bottom surface 102. Optionally, the arm rest 106 has distal notches 107 that mate with protrusions 230 on the arm assembly 20 for additionally support and restraint. One skilled in the art should readily understand that the base 10 may readily be configured to mount to the transom of the watercraft simply be attaching an angle-bracket to or otherwise adapting the bottom surface 102 for securement to the transom.

The base 10 also comprises an actuator attachment mechanism 119 for operative attachment to the actuator 30. In the illustrated embodiment, the actuator attachment mechanism 119 is a pivot pin interspaced between side walls 104. Alternatively, the actuator attachment mechanism 119 may comprise is a separate bracket carrying a pivot pin that extends from the bottom surface 102.

The base 10 may also comprise a guide 120. In the illustrated embodiment, the guide 120 comprises a yoke pivotally coupled to the base 10 on one end and on the other end has a pair of spaced apart arms 121. The arms 121 receive the motor shaft 2. The guide yoke 120 may also comprise a spacer 122 interspaced between the distal ends of the arms 121 to ensure that the shaft 2 remains between arms 121. The spacer 122 may be rotatably attached to the arms 121. Pivotal attachment allows the guide yoke 120 to rotate as the arm assembly 20 rotates between the deployed and stowed positions with the shaft 2 sliding through the arms 121. During deployment and stowing, the weight of the trolling motor is supported by the motor mount assembly 40, arm assembly 20, and the guide yoke 120, which eliminates the cantilever support associated with conventional motor mounts. The guide yoke 120 also secures the shaft, provides general stabilization, and reduces vibration when the troll motor is fully retracted and not in use by reducing, or eliminating, the lateral motion of the shaft. This restraint is important when the boat is in rough water. In an alternative embodiment, instead a pivoting guide yoke 120, the base 10 may extend to provide a guide notch in the front that seats the shaft 2. As the arm assembly 20 moves between the deployed and stowed positions, the mount assembly 40, arm assembly 20, and the guide 120 (or notched extension) support the weight of the trolling motor.

The base 10 may also comprise a back arm rest 130. The back rest arm rest 130 supports the arm assembly 20 in the stowed position to provide general stabilization, reduce vibrations, and secure the arm assembly. The back arm rest 130 preferably comprises a polymeric material that is capable of elastic deformation. The back arm rest 130 may also be shaped to seat the arm assembly 20 to provided additional stabilization.

The arm assembly 20 is pivotally attached to the back end of the base 10—the end farthest from the water. The arm assembly 20 rotates between the deployed position and the stowed position. In the deployed position (as in FIGS. 1 and 4), the arm assembly 20 forms an angle with the base of approximately 5 to 45 degrees, preferably 25 to 35 degrees. In the stowed position (as in FIGS. 2 and 6), the arm assembly 20 forms an obtuse angle with the base 10 of approximately 135 to 175 degrees, preferably 145 to 155 degrees.

Figure 2:
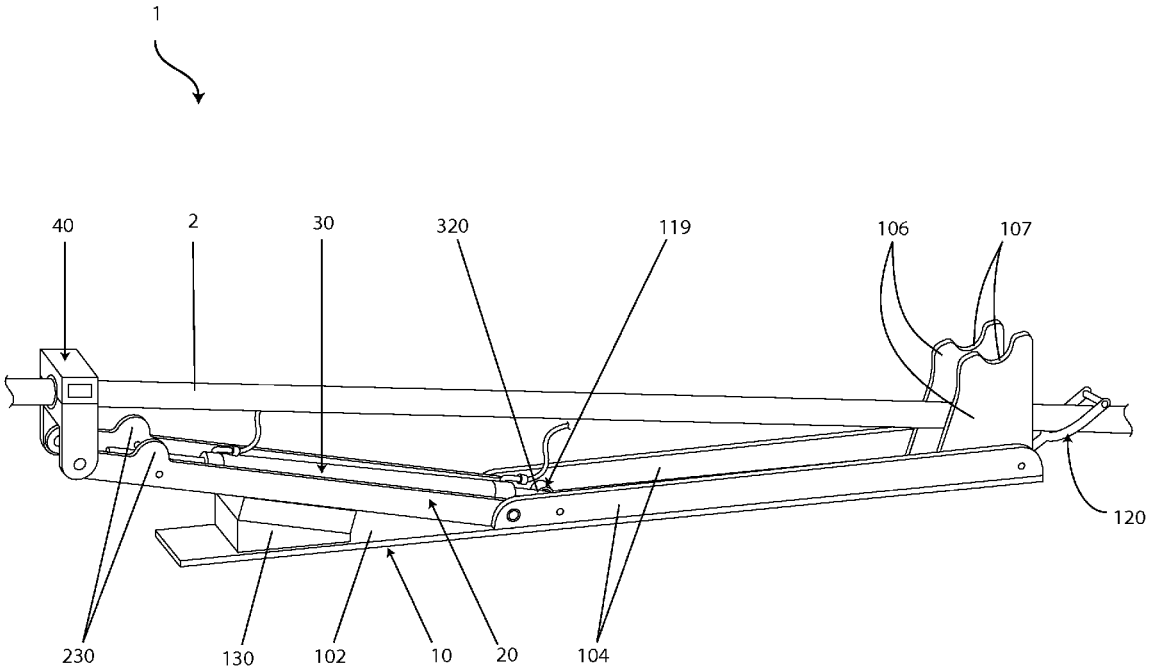
FIG. 2 is a perspective view of the mount in FIG. 1 in the stowed position.
Figure 3:
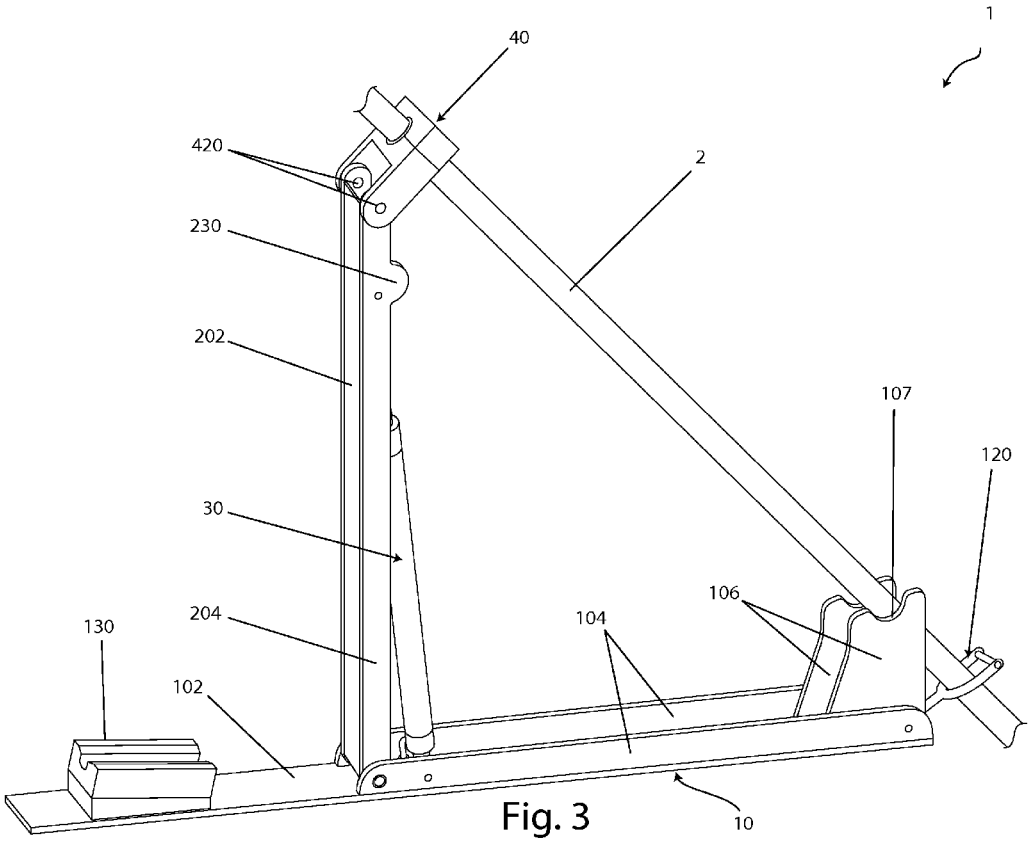
FIG. 3 is a perspective view of the mount in FIGS. 1-2 in an intermediate position.

Referring to FIGS. 1-3, in an embodiment, the arm assembly 20 is an elongated, generally rectangular three-walled arm comprising a top surface 202 reinforced by opposing side walls 204. The side walls 204 extend downward from the top surface 202. The arm is pivotally attached to the base 10 with a pair of pivot pins 225, or alternatively with one pivot pin interspaced between the side walls 104. The arm also comprises an actuator attachment mechanism 206 for operative attachment to the actuator 30. The actuator attachment mechanism 206 is a pivot pin 227 interspaced between side walls 204 with spacers 208 centering the actuator 30 on the pivot pin 227. In another embodiment, the actuator attachment mechanism 206 is a bracket with a pivot pin that extends downward from the top surface 202.

The actuator 30 comprises a user-controlled variable length portion 310. The actuator 30 has an attachment mechanism 320 on each end for operative engagement with the attachment mechanisms 119 and 206 on the base 10 and arm assembly 20, respectively. In an embodiment, the attachment mechanism 320 is an aperture for receiving the pivot pins of attachment mechanisms 119 and 206, which allows the actuator 30 to be operatively engaged with the base 10 and arm assembly 20. The arm assembly 20 is rotated between its fully deployed and stowed positions by changing the length of the variable length portion 310.

Figure 7:
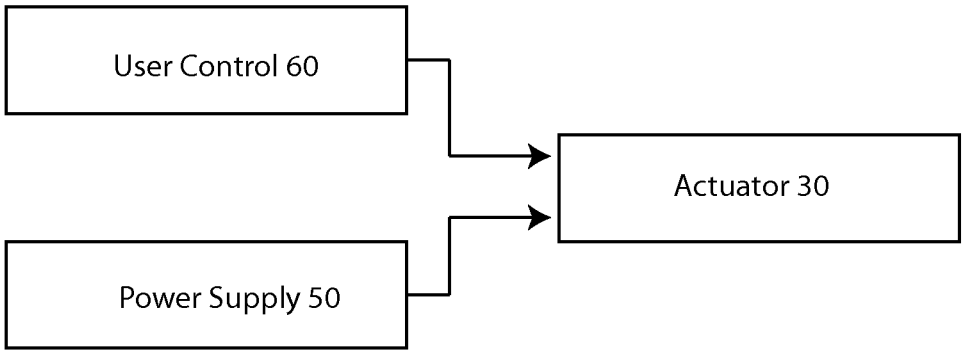
FIG. 7 is a simplified block diagram illustrating the control system and the power supply system.

The actuator 30 may be any suitable linear actuator, for example, hydraulic actuators, mechanical-electrical actuators, or gas actuators. FIG. 7 is a simplified block diagram illustrating the control system and the power supply system. For hydraulic and mechanical-electrical actuators, for example, hydraulic pistons or electric motors that drive lead screws, the actuator 30 is powered by a power supply 50 such as the battery used to start the watercraft's main motor, the battery(s) used to power the trolling motor, or a separate battery or series of batteries dedicated to the actuator 30. Preferably, the actuator 30 is powered by a separate a dedicated 12-volt, deep cycle marine battery, or a series of such batteries. The power supply 50 and any necessary components to operate the actuator 30, for example, a hydraulic pump, may be located in a stowage compartment within the watercraft. In an embodiment, the actuator 30 acts a locking mechanism that locks the arm assembly 20 in either the deployed or stowed position by not allowing any movement against the actuator, although other known and suitable locking mechanisms may be used.

Movement of the variable length portion 310 is controlled by a suitable user control device 60 which may be a separate controller or integrated into the control system of the trolling motor. For example, the user control may be a switch located any where on the watercraft, for example, near the watercraft console or on the mount 1, or the user control may be a wireless (for example, a RF or infrared transmitter) or wired remote (for example, a hand held control or foot pedal). Alternatively, the user control can be integrated with the controls of the trolling motor such as a foot pedal or remote control that controls the speed and direction of the trolling motor.

The motor mounting assembly 40 is pivotally attached to the end of the arm assembly 20, opposite the base 10. Motor mounting assemblies are known in the art, and thus, the motor mounting assembly 40 may comprise any known clamp, collar, sleeve, or other mechanism for attaching the trolling motor to the mount 1. In an embodiment, the motor mounting assembly 40 comprises a hollow receptacle 410 that is configured to accept and rotatably couple with the trolling motor shaft 2. The motor mounting assembly 40 may also comprises a locking mechanism for selectively securing the motor shaft 2 within the receptacle 410. The mounting assembly 40 comprises a pair of apertures 420 for receiving pivot pins, or alternatively a pivot pin interspaced between side walls 204 on the arm assembly 20, for pivotal attachment. As the arm assembly 20 rotates from the deployed position to the stowed position, the mounting assembly 40 rotates from a position that places the shaft 2 in a generally vertical alignment (as in FIGS. 1 and 4) to a position that places the shaft 2 in a generally horizontal or slightly inclined position (as in FIGS. 2 and 6).

Figure 4:
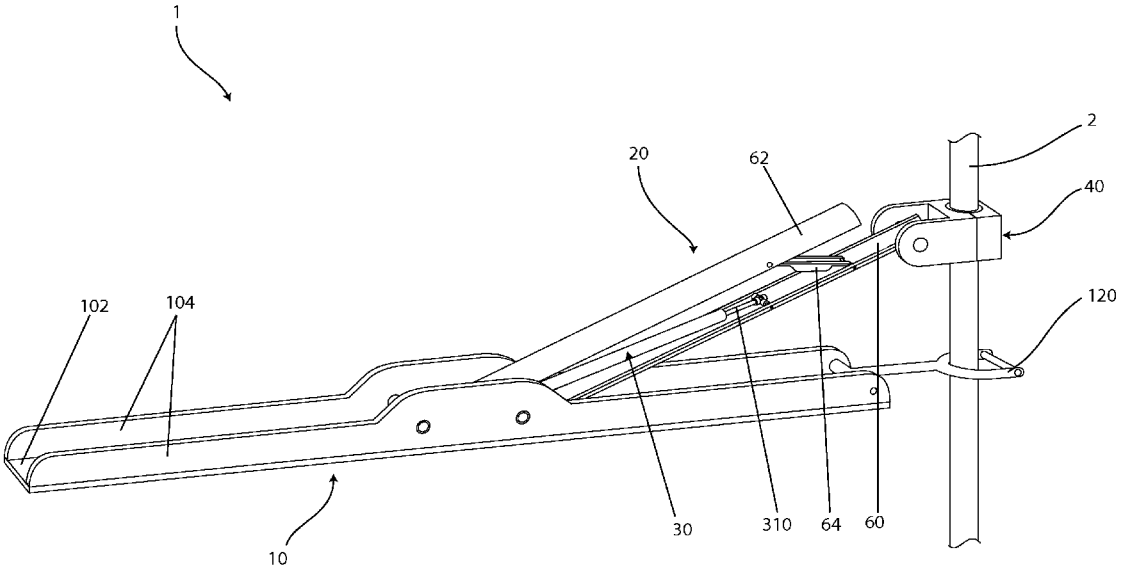
FIG. 4 is a perspective view of another embodiment of the mount in the deployed position.
Figure 5:
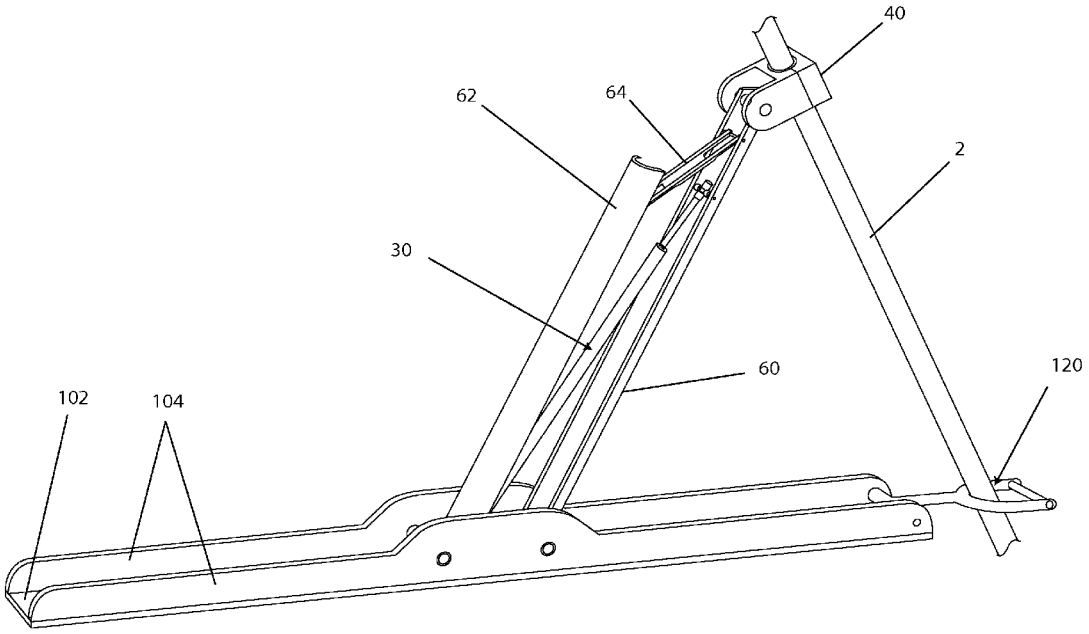
FIG. 5 is perspective view of the mount in FIG. 4 in an intermediate position.
Figure 6:
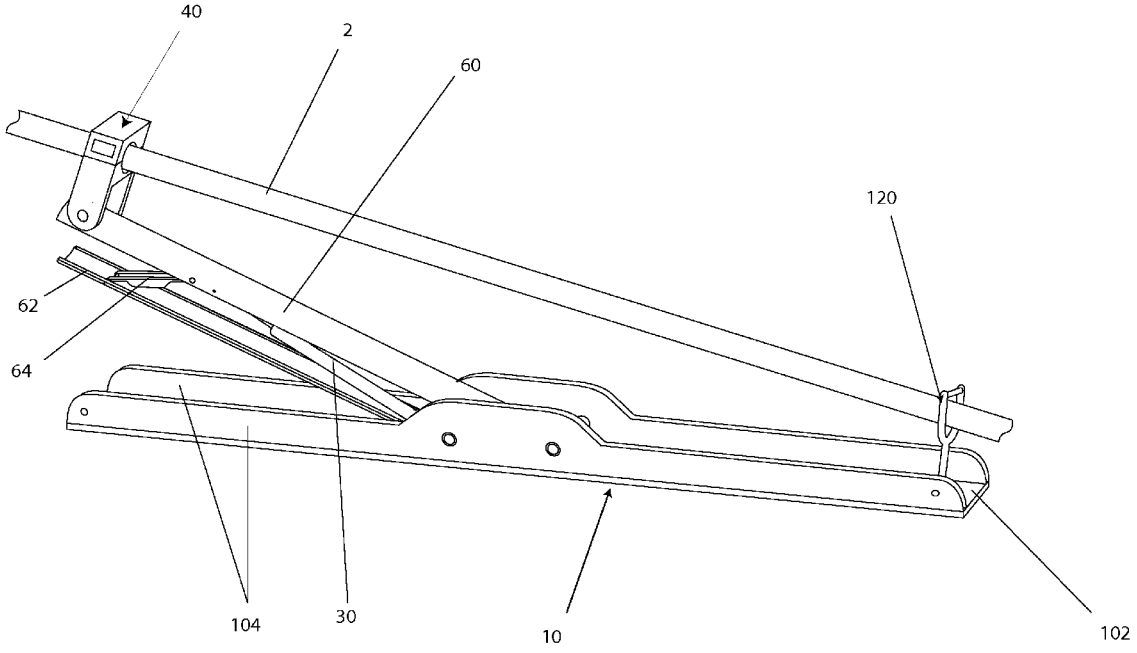
FIG. 6 is a perspective view of the mount in FIGS. 4-5 in the stowed position.

Referring to FIGS. 4-6, in an alternate embodiment, the arm assembly 20 creates a four bar linkage with the base 10 that serves as the fixed link of the four bar linkage. The arm assembly 20 comprises a first grounded link 60, a second grounded link 62, and a coupler link 64. The first and second grounded links 60 and 62 may each comprise either a single member having a hollow cross section such as a semi-circle (as illustrated in FIGS. 4-6) or a pair of congruent members spaced apart by at least one transverse pin or member. The first and second grounded links 60 and 62 are pivotally attached to the base 10. If the grounded links 60 and 62 each comprise a single member, each grounded link 60 and 62 has a pair of apertures for receiving a pivot pin interspaced between the side walls 104, and if the grounded links each comprise a pair of congruent members, each congruent member has an aperture for receiving the transverse pin interspaced between the members.

The coupler link 64 is pivotally attached on one end to the first grounded link 60 and on the other end to the second grounded link 62. The coupler link 64 has at least one aperture on each end for receiving a pivot pin interspaced between the walls of the first and second grounded links if the grounded links each comprise a single member, or receiving a transverse pin interspaced between the congruent members of the first and second grounded links if the grounded links each comprise a pair of congruent members.

Both ends of the actuator 30 are pivotally connected to the four-bar-linkage arm assembly 20 to move the arm assembly between the deployed and stowed positions. Preferably, one end of actuator 30 is attached to the pivot pin attaching the second grounded link 62 to the base 10, and the other end is attached to an intermediate point on the first grounded link 60—a pivot pin interspaced between the walls of a single member first grounded link or, if the first grounded link is a pair of members, a transverse pin interspaced between each member of the pair. However, the actuator 30 may be attached to any two points on the first grounded link 60, second grounded link 62, coupling link 64, or fixed link (base 10) that is adapted to move the arm assembly 20 between the deployed and stowed positions.

The motor mounting assembly 40 is pivotally attached to the first grounded link 60, opposite the base 10. As the arm assembly 20 rotates from the deployed position to the stowed position, the mounting assembly 40 rotates from a position that places the shaft 2 in a generally vertical alignment (as in FIG. 4) to a position that places the shaft 2 in an generally horizontal or slightly inclined position (as in FIG. 6). Although in the illustrated embodiment, mounting assembly 40 is attached to the first grounded link 60, the mounting assembly 40 may be adapted to pivotally attach to the coupler link 64 or second grounded link 62.

The arm assembly 20 and actuator 30 may be completely enclosed by a protective cover that is pivotally attached to the base 10. Preferably, the cover comprises a rigid, lightweight plastic material. As the arm assembly 20 rotates between the deployed and stowed positions, the cover rotates accordingly. The cover protects the components of the arm assembly 20 and actuator 30 from the weather elements as well as provides a safety guard to prevent pinching by any of the moving components.

Having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

What is claimed:

1. A trolling motor mount for attaching a trolling motor having a shaft to a watercraft, comprising:

a base for attaching the mount to the watercraft comprising a pivotally attached guide extending from an end of said base and below a motor mount assembly;

an arm assembly comprising an elongated arm pivotally coupled to the base at a fixed pivot point;

the motor mount assembly pivotally coupled to the elongated arm for securing the trolling motor;

and an actuator operatively coupled at a first end to said base and at a second end to the elongated arm at point between said fixed pivot point and said motor mount assembly for moving the arm assembly between a fully deployed position and a fully stowed position wherein the guide seats the trolling motor's shaft and supports a portion of the trolling motor's weight as the arm assembly moves between the deployed position and the stowed position.

2. The trolling motor mount according to claim 1, wherein the actuator is a mechanical-electrical actuator or a hydraulic actuator.

3. The trolling motor mount according to claim 1, further comprising a user control, the user control comprising one from the group consisting of a switch, a wireless remote control, and a wired remote control.

4. The trolling motor mount according to claim 2, wherein the arm assembly comprises a first grounded link pivotally attached to the base, a second grounded link pivotally attached to the base, and a coupler link pivotally attached to the first grounded link and the second ground link, whereby the first grounded link, second grounded link, and coupler link form a four bar linkage with the base.

5. The trolling motor mount according to claim 4, wherein the first grounded link and the second grounded link each comprise a single linkage member.

6. The trolling motor mount according to claim 4, wherein the first grounded link and the second grounded link each comprise a pair of linkage members coupled together by at least one transverse pin.

7. The trolling motor mount according to claim 4, wherein the actuator is operatively attached to the base and to the first grounded link.

8. The trolling motor mount according to claim 4 further comprising a user control, the user control comprising one from the group consisting of a switch, a wireless remote control, and wired remote control.

9. A trolling motor mount for attaching a trolling motor having a shaft to a watercraft, comprising:

a base for attaching the mount to the watercraft, said base comprising a pair of panels that support an arm assembly in the deployed position;

the arm assembly comprising an elongated arm pivotally coupled to the base at a fixed pivot point;

a motor mount assembly pivotally coupled to the elongated arm for securing the trolling motor;

and an actuator operatively coupled at a first end to said base and at a second end to the elongated arm at point between said fixed pivot point and said motor mount assembly for moving the arm assembly between a fully deployed position and a fully stowed position wherein said panels each have a notch, and the elongated arm has a pair of protrusions that conform to the shape of each said notch, whereby the protrusions are seated in the notches in the deployed position.

10. The trolling motor mount according to claim 9, wherein the actuator is a mechanical-electrical actuator or a hydraulic actuator.

11. The trolling motor mount according to claim 9, further comprising a user control, the user control comprising one from the group consisting of a switch, a wireless remote control, and a wired remote control.

* * * * *